US005698353A

United States Patent [19]

Jeong

[11] Patent Number: 5,698,353

[45] Date of Patent: Dec. 16, 1997

[54] FLAT DISPLAY AND METHOD OF ITS MANUFACTURE

[75] Inventor: Seong Jae Jeong, Kyungsangbuk-Do, Rep. of Korea

[73] Assignee: Orion Electric Company, Ltd., Kyungsangbuk-Do, Rep. of Korea

[21] Appl. No.: 553,534

[22] PCT Filed: Mar. 31, 1994

[86] PCT No.: PCT/KR94/00029

§ 371 Date: May 2, 1996

§ 102(e) Date: May 2, 1996

[87] PCT Pub. No.: WO95/27303

PCT Pub. Date: Dec. 10, 1995

[51] Int. Cl.[6] ..... H01J 11/00; H05B 32/12

[52] U.S. Cl. ..... 430/26; 430/23; 430/320; 430/321; 430/323; 427/585; 427/64; 427/66; 427/68; 313/582; 313/586; 313/587

[58] Field of Search ..... 430/23, 26, 320, 430/321, 323, 324; 313/582, 586, 587; 427/585, 64, 66, 68

[56] References Cited

U.S. PATENT DOCUMENTS

| | | | |
|---|---|---|---|
| 3,836,393 | 9/1974 | Ersthausen et al. | 313/587 |
| 4,977,350 | 12/1990 | Tanaka et al. | 313/509 |
| 5,164,799 | 11/1992 | Uno | 313/509 |
| 5,432,015 | 7/1995 | Wu et al. | 313/509 |

FOREIGN PATENT DOCUMENTS

| | | |
|---|---|---|
| 57-44180 | 3/1982 | Japan . |
| 60-130097 | 7/1985 | Japan . |
| 1-283792 | 11/1989 | Japan . |
| 2-30094 | 1/1990 | Japan . |
| 2-152192 | 6/1990 | Japan . |
| 2-262295 | 10/1990 | Japan . |

*Primary Examiner*—Martin Angebranndt
*Attorney, Agent, or Firm*—Fish & Richardson P.C.

[57] ABSTRACT

The present invention discloses a flat display.

The flat display is obtained by sealing an electro luminescent display which emit red and green light to a plasma display panel which emit blue light. One discharge space formed in the plasma display panel holds the red and green luminescent patterns in the electro luminescent display in common.

6 Claims, 3 Drawing Sheets

FLAT DISPLAY AND METHOD OF ITS MANUFACTURE

FIELD OF THE INVENTION

This invention relates to a flat display and method of its manufacture, and more particularly to a flat display combining an electro luminescent display and a plasma display panel.

BACKGROUND OF THE INVENTION

Generally, an electro luminescent display(ELD) is very likely to a plasma display panel(PDP) using a gas discharge in the light of its structure and drive method except that it has a luminescent layer which emit light by electric filed formed between an anode and a cathode, wherein the luminescent layer is formed by solid state, so the ELD can easily manufacture in thinner thickness than that of the PDP caused by adopting such a luminescent means formed by solid state.

Such a ELD or PDP have need of three color, i.e., blue, green and red, to display a color picture, however, in case of the ELD, luminescent materials to emit green and red light can obtain a desired brightness while luminescent materials to emit blue light can not obtain a desired brightness, so it is difficult to display a color picture by the ELD, and in case of the PDP, it is possible to display a color picture but it has a defect in that a fine processing to accomplish a high density color picture is difficult.

Therefore, it is the object of the present invention to provide a flat display and method of its manufacture which can solve the above problems by combining a plasma display panel and a luminescent panel.

SUMMARY OF THE INVENTION

To achieve the above object, a flat display according to the present invention, comprises:

an electro luminescent display 20 to emit red and green light; and a plasma display panel 30 which is combined to the electro luminescent display 20.

A method of manufacturing a flat display according to the present invention, comprises the steps of:

forming a first transparent electrode 2 on a first glass substrate; forming a first insulating layer 3 on a resulting structure after forming the first transparent electrode and forming a red luminescent pattern 5 and a green luminescent pattern 4 on the first insulating layer 3 and then forming a second transparent electrode 7 on a resulting structure after forming the red and green luminescent patterns; forming a strong insulating layer 8 and protecting layer 14 on the second transparent electrode, thereby forming an electro luminescent display; forming a metal electrode pattern 10 on a second glass substrate; forming a blue luminescent layer 11 on a resulting structure after forming the metal glass substrate; forming a column partition 12 and a row partition 13 to form a discharge space on the blue luminescent layer 11, thereby forming a plasma display panel 30; and sealing the electro luminescent display 20 to the plasma display panel 30 by a sealing member 15 and injecting a penning gas in the discharge space 16.

DETAILED DESCRIPTION OF THE INVENTION

Below, this invention will be described in detail with reference to accompanying drawings.

FIG. 1 through FIG. 6 are sectional views illustrating a method of manufacturing a flat display according to the invention.

Figure 1:
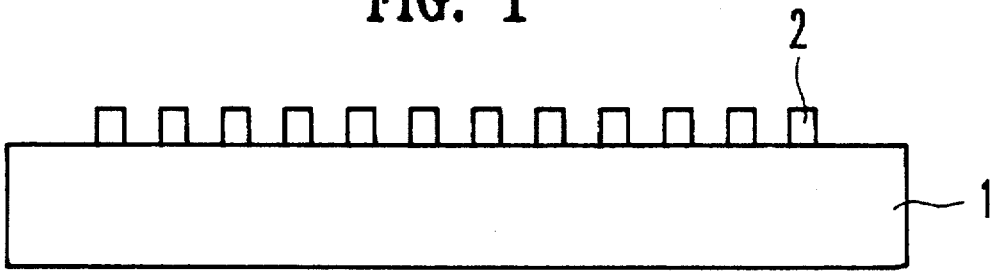
FIG. 1 through FIG. 6 are sectional views illustrating a method of manufacturing a flat display according to the invention.
Figure 2:
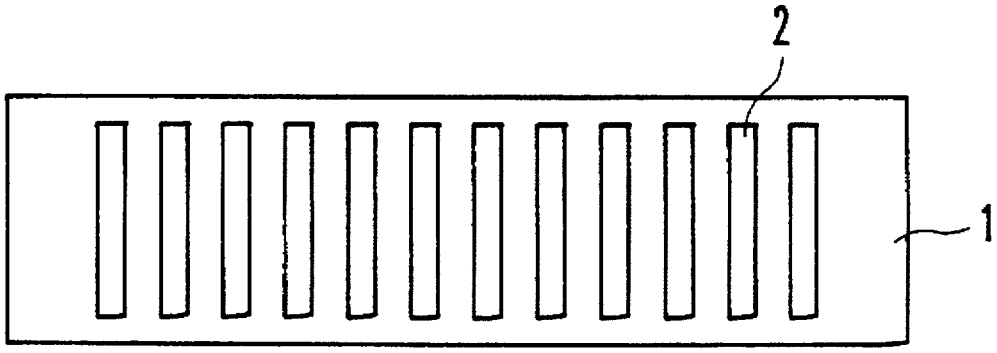

Referring to FIG.1 indium tin oxide(ITO) is coated on a first glass substrate 1 and the ITO is then patterned by a photolithography process, thereby forming a plurality of transparent electrodes 2 as shown in FIG. 2.

To performing the above patterning process, the indium tin oxide coated the first glass substrate 1 is cleaned and a photoresist is then coated on the indium tin oxide and a photoresist soft baking process is performed. A mask is arranged on the photoresist and a selected portion of the photoresist is exposed to the light by means of a development process and the mask is removed and exposed portions of the photoresist are then removed, thereby forming a photoresist pattern. After the photoresist pattern is formed, a hard baking process is performed and exposed portions of the ITO are etched using the photoresist pattern as a mask and the photoresist pattern is then removed, thereby forming a plurality of the first transparent electrode 2.

At the above etching process, etchant is $FeCl_3$:HCl (1:1), $HNO_3$:HCl(1:1) or HCl:$H_2O$(1:1).

Figure 3:
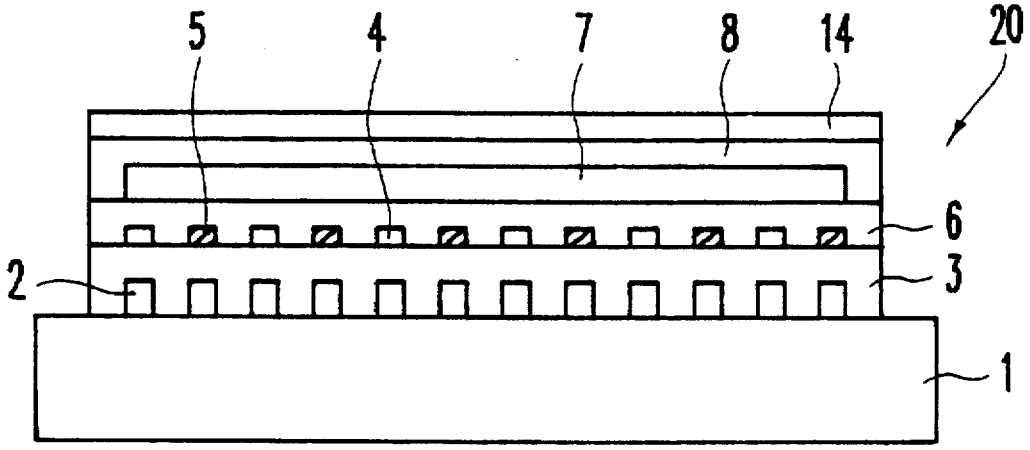
Figure 4:
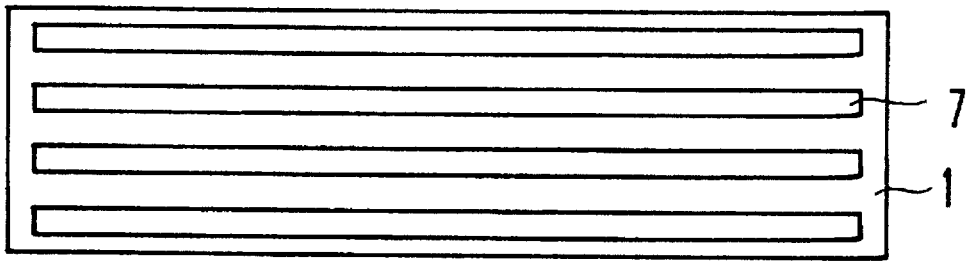

Referring to FIG. 3, a first insulating layer 3 is formed, for example, with thickness of 300 Å, on a resulting structure after forming the transparent electrode of FIG. 1 by a radio frequency(RF) sputtering process. A red luminescent materials is deposited on the first insulating layer for example, with a thickness of 5000 Å and the red luminescent materials is then selectively etched by a photolithography process, thereby forming a red luminescent pattern 5. A green luminescent materials is deposited, for example, with a thickness of 5000 Å, on a resulting structure after forming the red luminescent pattern 5 and the green luminescent materials is etched by a photolithography process so that the green luminescent materials remains between the red luminescent pattern 5, thereby forming a green luminescent pattern 4. A second insulating layer 6 is formed on the resulting structure after forming the green luminescent pattern 5, for example, with a thickness of 3000 Å and an ITO is then deposited on the second insulating layer 6 by a RF sputtering process. The ITO is patterned to cross with the first transparent electrode 2 as shown in FIG. 4, thereby forming a plurality of second transparent electrodes 7. A strong dielectric layer 8 is formed by the RF sputtering on the resulting structure after forming the second transparent electrode, for example, with a thickness of 1 μm. A MgO protecting layer 13 is formed on the dielectric layer 8, thereby forming a part of the PDP on an electro luminescent display.

The first insulating layer 3 must be formed by non-oxidization materials such as $Si_3N_4$ because the red luminescent materials such as Ca:Eu formed on the first insulating layer 3 is easily react with oxygen.

The red luminescent materials is formed with CaS:Eu, wherein the CaS:Eu is deposited by an electron beam deposition process using a pellet. Also, the green luminescent materials is formed with ZnS:Tb, wherein the deposition process of the ZnS:Tb is identical to that of the red luminescent materials.

The second insulating layer 6 is formed of $Si^3N_4$ and the strong dielectric layer is formed of $SrTiO_3$ or $BaTiO_3$.

Figure 5:
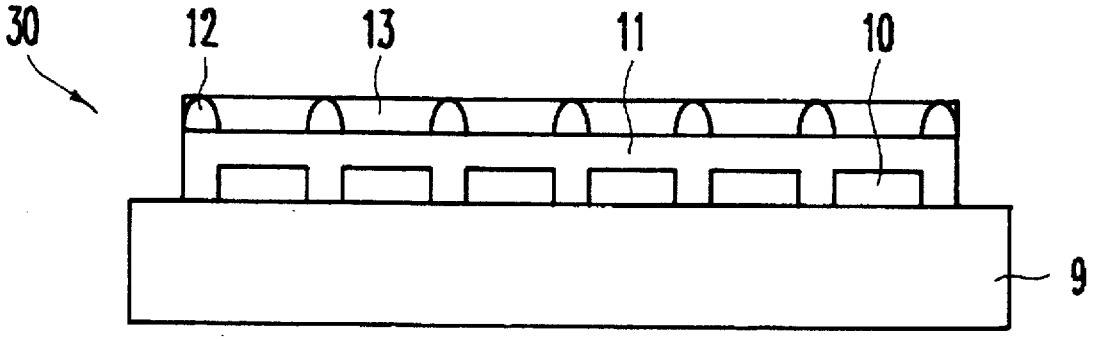
Figure 6:
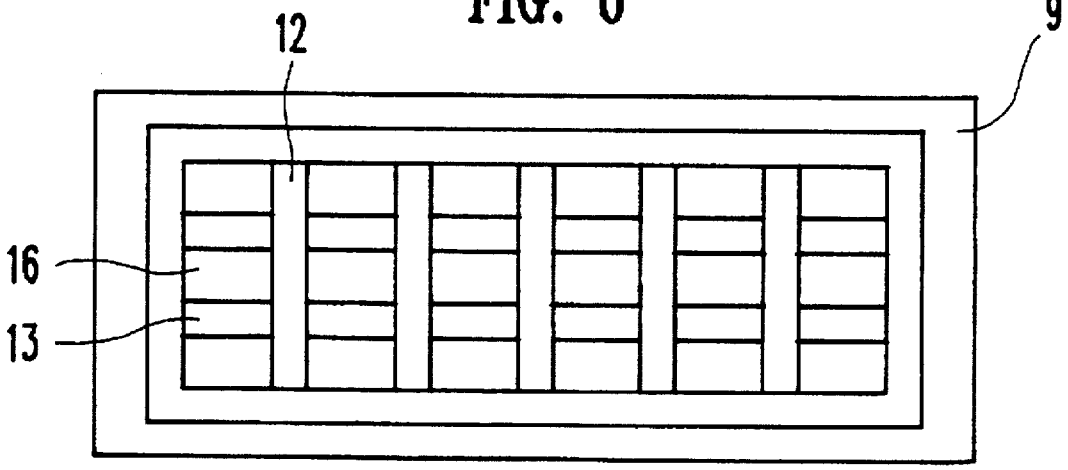

Referring to FIG. 5, an aluminum layer is formed on a second glass substrate 9, for example, with a thickness of 4000 Å and a metal electrode pattern 10 is then formed by patterning the aluminum layer using a photolithography process. A blue luminescent layer($BaMgAl_{14}O_{23}$ : $Eu^{2+}$) 11 for the PDP is formed on a resulting structure forming the metal electrode pattern 10 by a printing process and a column partition 12 and a row portion 13 are then formed, for example, with a height of 150 μm on a resulting structure after forming the blue luminescent layer 11 by a printing process, as shown in FIG. 6, thereby forming a plasma display panel.

Figure 7:
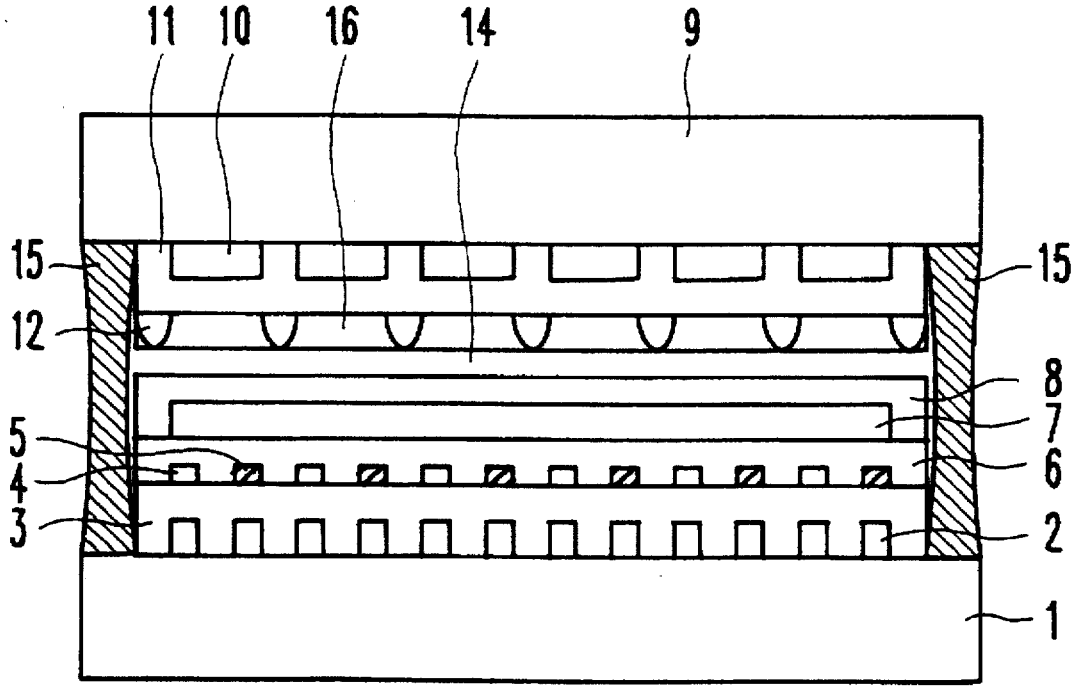
FIG. 7 illustrates a flat display panel according to the invention.

Referring to FIG. 7, the electro luminescent display 20 of FIG. 3 is combined to the plasma display panel 30 of FIG. 5 by sealing member 15 and a penning gas is then injected to a discharge space 16 which is formed by the column and row partitions 12 and 13.

As shown in FIG. 7, red and green light is emitted by an electro luminescent display method while blue light is emitted by an gas discharge method and one discharge space 16 holds the red and green luminescent patterns(5 and 4)in common.

INDUSTRIAL APPLICABILITY

As described above, as a result of the present invention, since the electro luminescent display is jointed to the plasma display panel, the present invention is very useful to a display equipment which requires a color picture of high distinction.

What is claimed is:

1. A method of manufacturing a flat display, comprising:

forming a first transparent electrode on a first glass substrate;

forming a first insulating layer on a resulting structure after forming said first transparent electrode;

forming a red luminescent pattern and a green luminescent pattern on said first insulating layer;

forming a second transparent electrode on a resulting structure after forming said red and green luminescent patterns;

forming an strong dielectric insulating layer and a protecting layer on said second transparent electrode, thereby forming an electro luminescent display;

forming a metal electrode pattern on a second glass substrate;

forming a blue luminescent layer on a resulting structure after forming said metal glass substrate:

forming a column partition and a row partition to form a discharge space on said blue luminescent layer, thereby forming a plasma display panel; and sealing said electro luminescent display to said plasma display panel by a sealing member and injecting a penning gas in said discharge space.

2. The method of claim 1, wherein said first insulating layer is formed of non-oxidizing materials.

3. The method of claim 1, wherein said red luminescent pattern is formed by an electron beam deposition process and a photolithography process using CaS:Eu as the luminescent material.

4. The method of claim 1, wherein said strong dielectric insulating layer is formed of $SrTiO_3$.

5. The method of claim 1, wherein said strong dielectric insulating layer is formed of $BaTio_3$.

6. The method of claim 1, wherein said green luminescent pattern is formed by an electron beam disposition process and a photolithography process using ZnS:Tb as the luminescent material.

* * * * *